US005542258A

United States Patent [19]

Shim

[11] Patent Number: 5,542,258

[45] Date of Patent: Aug. 6, 1996

[54] METHOD FOR CONTROLLING A DEW PREVENTION HEATER FOR A REFRIGERATOR

[75] Inventor: Jae E. Shim, Kunpo, Rep. of Korea

[73] Assignee: Samsung Electronics Co., Ltd., Suwon, Rep. of Korea

[21] Appl. No.: 386,099

[22] Filed: Feb. 9, 1995

[30] Foreign Application Priority Data

Mar. 31, 1994 [KR] Rep. of Korea ..... 94-6761

[51] Int. Cl.[6] ..... F25D 21/04

[52] U.S. Cl. ..... 62/80; 62/150; 62/275

[58] Field of Search ..... 62/80, 128, 139, 62/150, 272, 273, 275, 453

[56] References Cited

U.S. PATENT DOCUMENTS

| | | | |
|---|---|---|---|
| 3,859,502 | 1/1975 | Heaney | 62/275 X |
| 3,939,666 | 2/1976 | Bashark | 62/150 |
| 4,127,765 | 11/1978 | Heaney | 62/150 X |
| 4,261,179 | 4/1981 | Dageford | 62/275 X |
| 4,341,089 | 7/1982 | Ibrahim et al. | 62/453 X |
| 4,862,701 | 9/1989 | Small et al. | 62/150 |

FOREIGN PATENT DOCUMENTS

3/133268 5/1991 Japan .

*Primary Examiner*—Harry B. Tanner

*Attorney, Agent, or Firm*—Burns, Doane, Swecker & Mathis, L.L.P.

[57] ABSTRACT

A refrigerator includes a freezing compartment and refrigerating compartment. Dew prevention heaters are provided for the respective compartments. The dew prevention heater for the freezing compartment cannot be activated if the freezer temperature is above 0° C., but it can be activated if that temperature is below 0° C. as follows: if the compressor is on, then the heater is always on; and if the compressor is off, then the heater will cycle on and off at a frequency dependent upon the magnitude of the temperature outside of the refrigerator. The activation of the dew prevention heater for the refrigerating compartment is independent of the temperature of the refrigerating compartment. Rather, that heater is "off" if the compressor is "off", and if the compressor is "on", the heater will cycle on and off at a frequency dependent upon the temperature outside of the refrigerator.

14 Claims, 7 Drawing Sheets

FIG. 7(A)
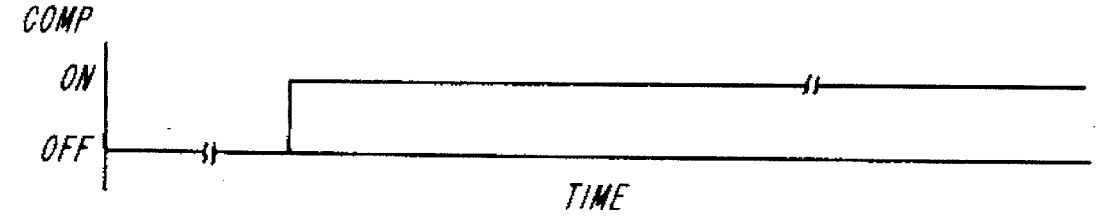
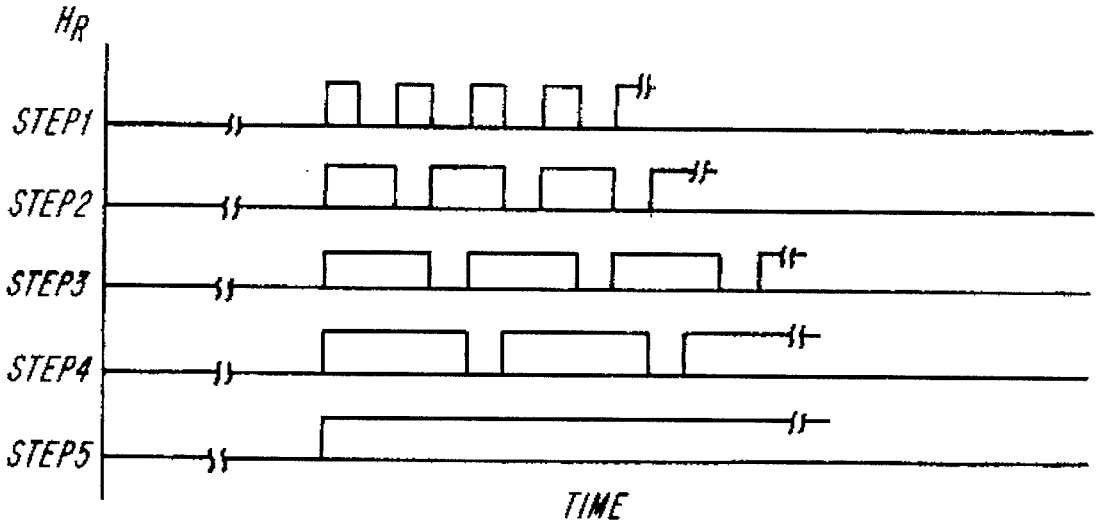
FIG. 7(B)

METHOD FOR CONTROLLING A DEW PREVENTION HEATER FOR A REFRIGERATOR

BACKGROUND OF THE INVENTION

1. Field of the Invention

The present invention is related to a method for controlling a dew prevention heater.

2. Description of the Prior Art

For the purpose of raising the user's convenience and spatial efficiency, a door apparatus (hereinafter, called a French door apparatus), in which two doors are disposed on the left and right sides of a single compartment and designed to be opened and closed at the center of the compartment, has been developed. This French door apparatus is favorable to a refrigerator with large volume.

FIG. 1 is a perspective view of a conventional refrigerator with a French door apparatus.

Referring to FIG. 1, refrigerator 100 with a French door apparatus has two doors 110L and 110R attached to a single compartment. The side edges of doors 110L and 110R are rotatably supported by respective upper and lower hinges 102U and 102L secured to each corner of the front side of the compartment. Two handles 104L and 104R are secured to the other end portions of doors 110L and 110R.

FIG. 2 is an enlarged cross sectional view of the contact portion of two doors in a refrigerator as shown in FIG. 1.

Referring to FIG. 2, a narrow gap A is provided between doors 110L and 110R so that doors 110L and 110R may be effortlessly opened or closed. Furthermore, a partition member 114 is rotatably secured to the inner wall 112R of either door 110R in order to prevent air from circulating through the narrow gap A. The partition member 114 is rotatably supported by hinge axis 116.

In the afore-mentioned construction, partition member 114 unfolds as shown in FIG. 2 when doors 110L and 110R are closed, whereas when doors 110L and 110R are opened, partition member 114 rotates together with door 110R and folds into a receiving member 118 arranged in the vicinity of hinge axis 116.

By the way, the interior and exterior surfaces of partition member 114 are continuously in contacts with relatively cool and warm air in the interior and exterior portions, respectively of the compartment. Accordingly, unwanted dew forms on the exterior surface of partition member 114. To prevent this formation of unwanted dew, a heater 120 is conventionally provided in partition member 114.

A more detailed explanation of the French door apparatus and the mounting structure of the heater will be omitted because it is disclosed in many patent publications, including Japanese Patent Laid-Open Publication No. 113268 (May 14, 1991).

FIGS. 3(A) to (C) are schematic diagrams showing conventional driving systems of a dew formation prevention heater(s) for a refrigerator.

In FIGS. 3(A) to (C), reference numeral 1 denotes a relay switch; 2 denotes a compressor; 3 denotes a dew formation prevention heater (hereinafter, called an F/heater) for a freezing compartment; 4 denotes a dew formation prevention heater (hereinafter, called an R/heater) for a refrigerating compartment; and, AC denotes a commercial A.C. power supply source.

According to FIG. 3A, the F/heater 3 is always activated and R/heater 4 is activated together with compressor 2 in FIG. 3*b* both F/heater 3 and R/heater 4 are activated together with compressor 2; in FIG. 3C the F/heater 3 solely provided is activated together with compressor 2.

However, the conventional driving systems have some problems in that excessive electric power is consumed by the heater(s). Therefore, the refrigerating ability deteriorates because the activation of the heater(s) is controlled without consideration of the outer temperature of the refrigerator and the indoor temperature of each compartment. In addition, the conventional driving systems of the heater(s) have a problem in that the formation of dew is not effectively prevented.

SUMMARY OF THE INVENTION

It is an object of the present invention to provide a method for controlling the activation and activation timing pattern of a dew formation prevention heater(s) for a refrigerator based on whether or not the compressor is activated and the temperature of specific parts of the refrigerator, thereby effectively preventing the formation of dew.

It is another object of the present invention to provide a method for controlling the activation and activation timing pattern of a dew formation prevention heater(s) for a refrigerator based on whether or not the compressor is activated and the temperature of specific parts of the refrigerator, thereby decreasing the power consumption in the dew formation prevention heater(s).

To achieve these objects, the method according to the present invention is applicable to a refrigerator which includes at least one compartment for preserving food, two doors designed to be opened or closed in the center of each compartment, a partition member for preventing air from circulating through a narrow gap provided between the respective two doors during the closed state thereof, and a heater inserted into the partition member, for preventing dew from forming on the exterior surface of the partition member.

As to the freezing compartment, the method according to the present invention comprises the steps of detecting the outer temperature of the refrigerator; classifying the detected outdoor temperature one of a predetermined number of grades; and, intermittently activating the heater at a frequency which increases as the outer temperature increases.

In the method described above, the heater for the freezer is intermittently activated only while the compressor is not in operation, whereas the heater for the freezer is always activated while the compressor is in operation, that is, when the difference between the indoor and outer temperatures is relatively greater. According to the method described above, the formation of dew may be effectively prevented, and the power consumption in the heater for the freezer may be decreased.

If the indoor temperature of the freezing compartment is higher than a predetermined value, it is then desirable to stop the activation of the heater in order to prevent the decrease in refrigerating ability, even though the compressor is still in operation.

As to a refrigerating compartment where the difference between the indoor and outer temperatures is relatively lower than that of the freezing compartment, it is desirable to stop the activation of the heater for the refrigerating compartment while the compressor is not in operation, whereas it is desirable to intermittently activate the heater for the refrigerating compartment at a frequency which increases as the outer temperature increases, but only while the compressor is in operation. According to the method described above, the power consumption in the heater for the refrigerating compartment may be effectively decreased.

BRIEF DESCRIPTION OF THE DRAWINGS

The present invention will become more readily apparent from the following description in connection with the accompanying drawings wherein.

DETAILED DESCRIPTION OF THE PREFERRED EMBODIMENT

For a better understanding of the present invention, together with other and further objects, advantages and capabilities thereof, reference is made to the following disclosure in connection with the above-described drawings.

Figure 1:
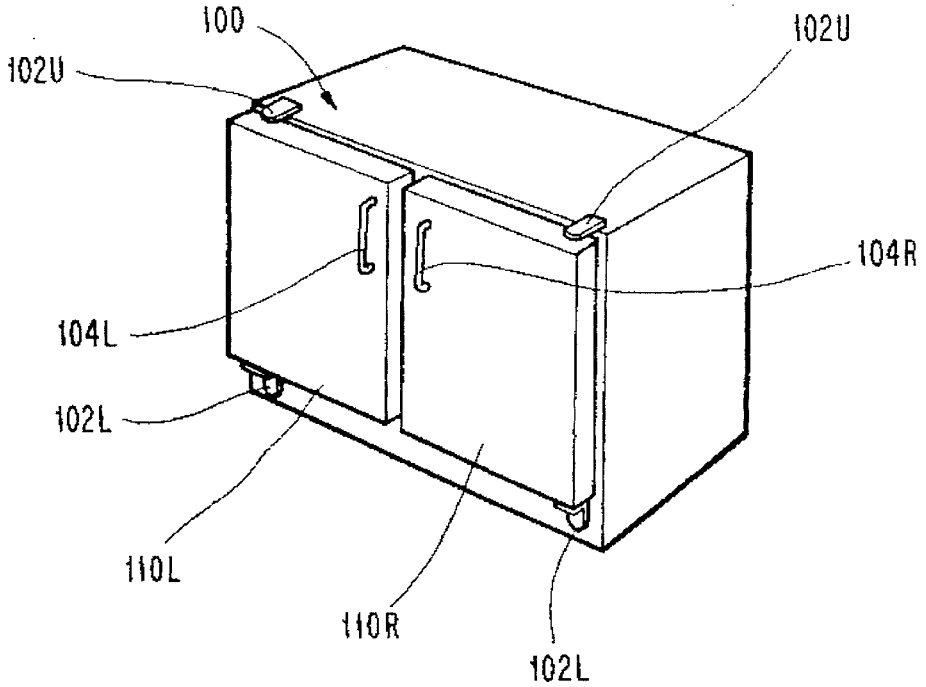
FIG. 1 (PRIOR ART)
FIG. 1 is a perspective view of a conventional refrigerator with a French door apparatus.
Figure 2:
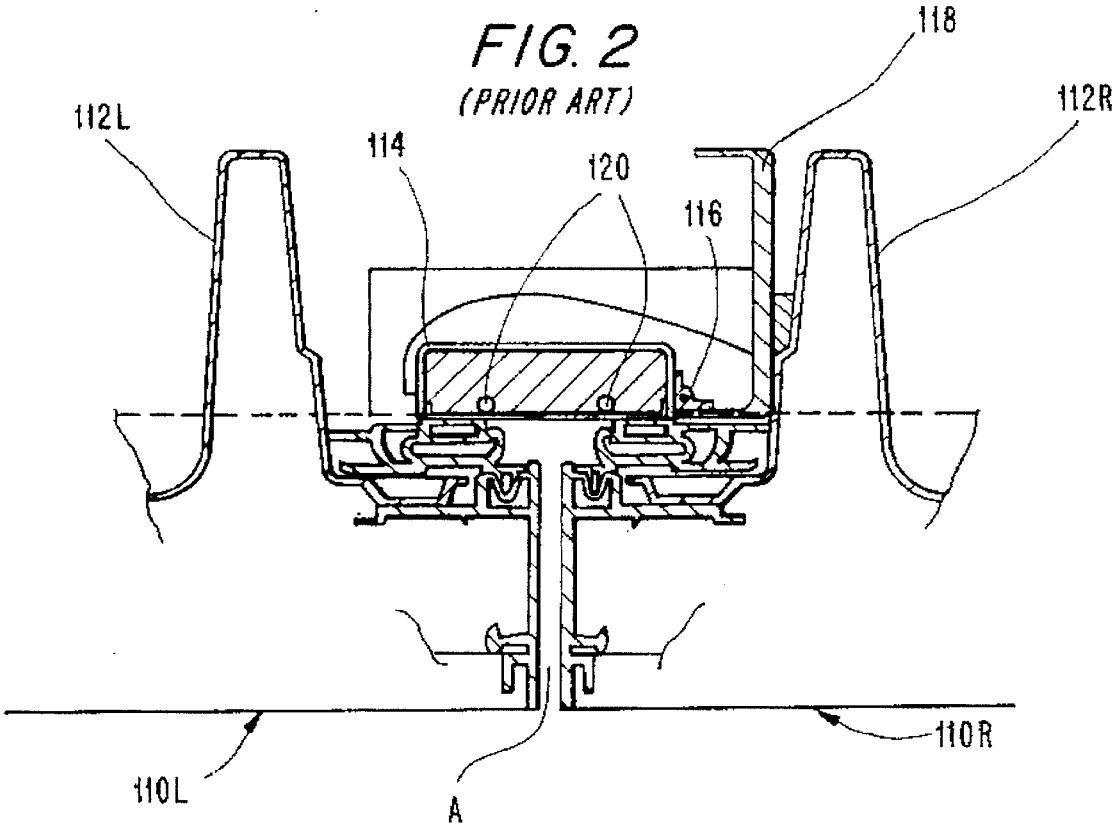
FIG. 2 (PRIOR ART)
FIG. 2 is an enlarged cross sectional view of the contact portion of two doors in a refrigerator shown in FIG. 1.
Figure 3A:
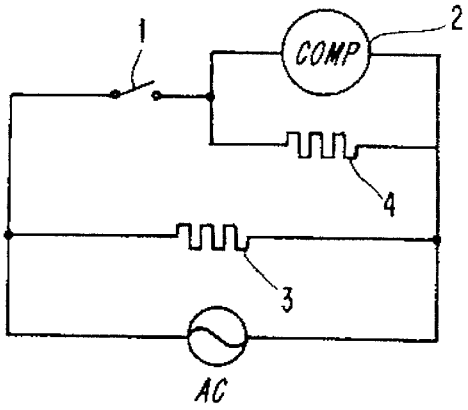
FIG. 3(A) (PRIOR ART)
FIGS. 3(A) to (C) are schematic diagrams showing conventional driving systems for a dew formation prevention heater(s) for a refrigerator.
Figure 3B:
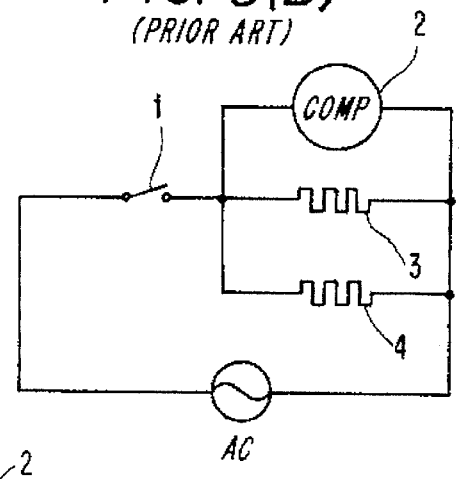
FIG. 3(B) (PRIOR ART)
Figure 3C:
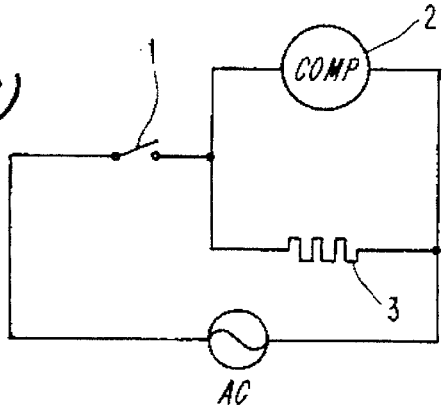
FIG. 3(C) (PRIOR ART)
Figure 4:
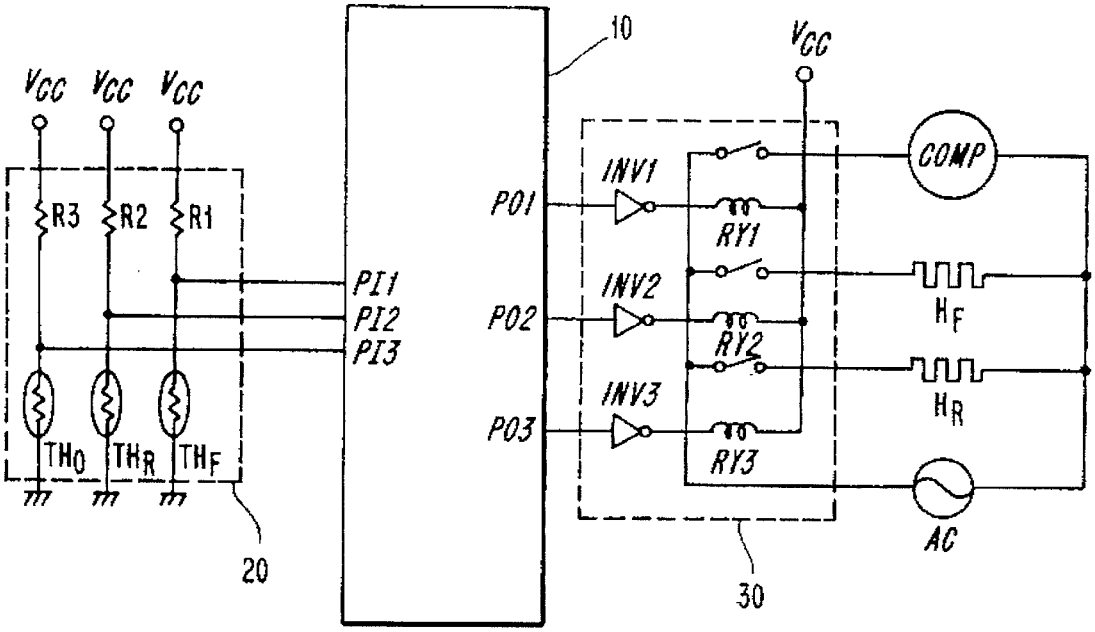
FIG. 4 is a control circuit diagram for dew formation prevention heaters according to the present invention.

FIG. 4 is a control circuit diagram for dew formation prevention heaters according to the present invention.

Referring to FIG. 4, the control circuit comprises a temperature detecting section 20 for detecting the indoor temperatures of freezing and refrigerating compartments and the outer temperature of the refrigerator, a microprocessor 10 for determining the magnitude of the indoor and outdoor temperatures based on the temperature signals from the temperature detecting section 20 and for outputting control signals to each electric part of the refrigerator, and a load driving section 30 for selectively connecting (disconnecting) electric power A.C. to (from) a compressor COMP, an F/heater $H_F$, and an R/heater $H_R$ respectively provided for the refrigerating and freezing compartments.

The temperature detecting section 20 includes a thermistor set $TH_F$ and dividing resistor R1 connected in series for detecting the indoor temperature of the freezing compartment, a thermistor set $TH_R$ and dividing resistor R2 connected in series for detecting the indoor temperature of the refrigerating compartment, and a thermistor set $TH_O$ and dividing resistor R3 connected in series for detecting the outer temperature of the refrigerator. Each junction of the thermistor set and associated resistor $TH_F$ and R1; $TH_R$ and R2; $TH_O$ and R3 is respectively connected to input terminals PI1 to PI3 of microprocessor 10.

The microprocessor 10 converts the temperature signals (analog signals) provided through input terminals PI1 to PI3 into corresponding digital signals, determines the magnitude of the indoor and outer temperatures based on the digital signals, and controls the activation and activation timing pattern of the F/heater and R/heater according to a control program described hereinafter.

The load driving section 30 includes invertors INV1 to INV3 for inverting the respective control signal transmitted through output terminals PO1 to PO3 of microprocessor 10, and relay switches RY1 to RY3 for connecting (disconnecting) electric power A.C. to compressor COMP, F/heater $H_F$, and R/heater $H_R$ according to the output state of invertors INV1 to INV3.

Figure 5A:
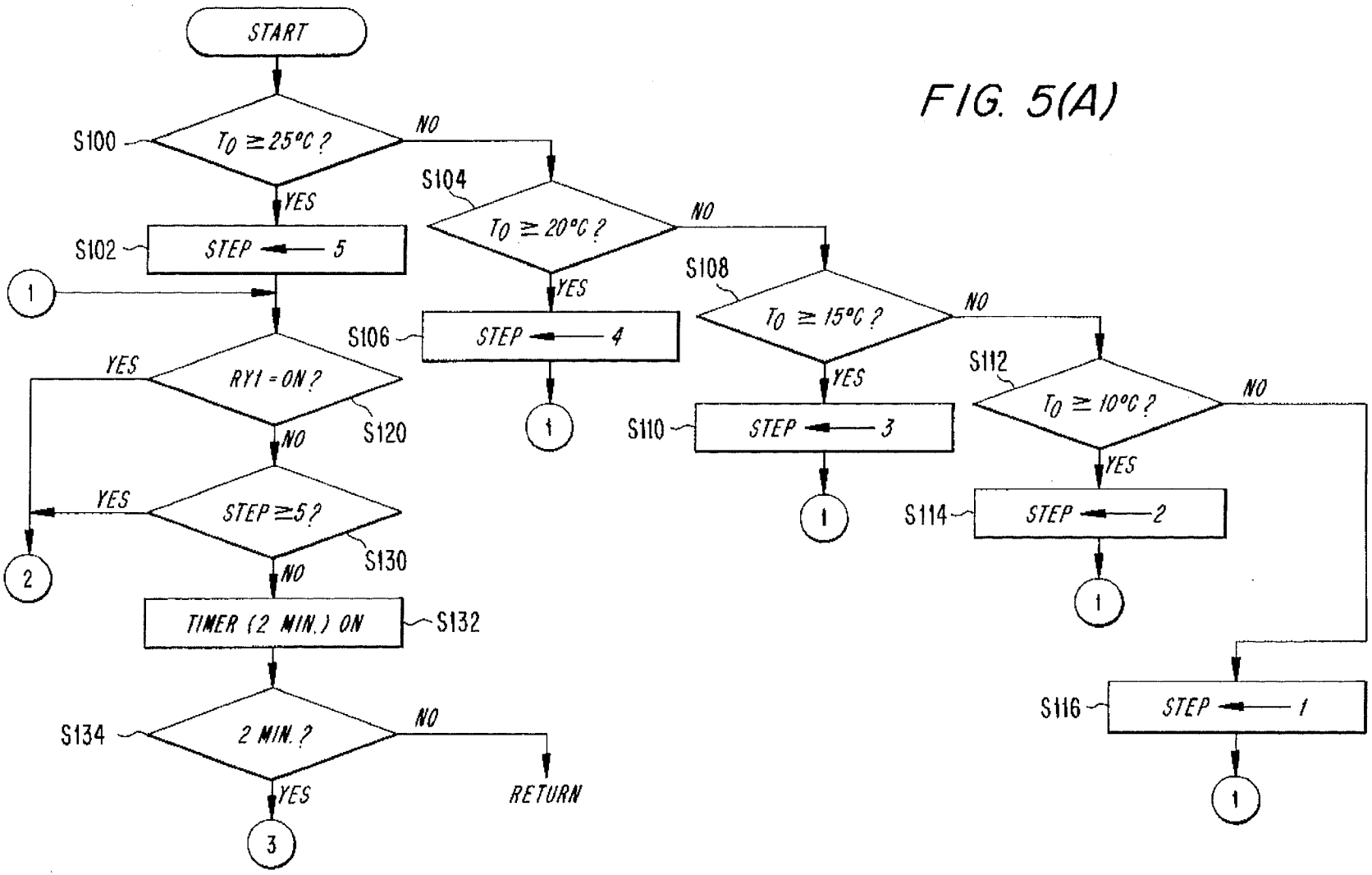
FIGS. 5(A) to (C) are flow charts explaining a method for controlling the activation of dew formation prevention heaters according to the present invention.
Figure 5B:
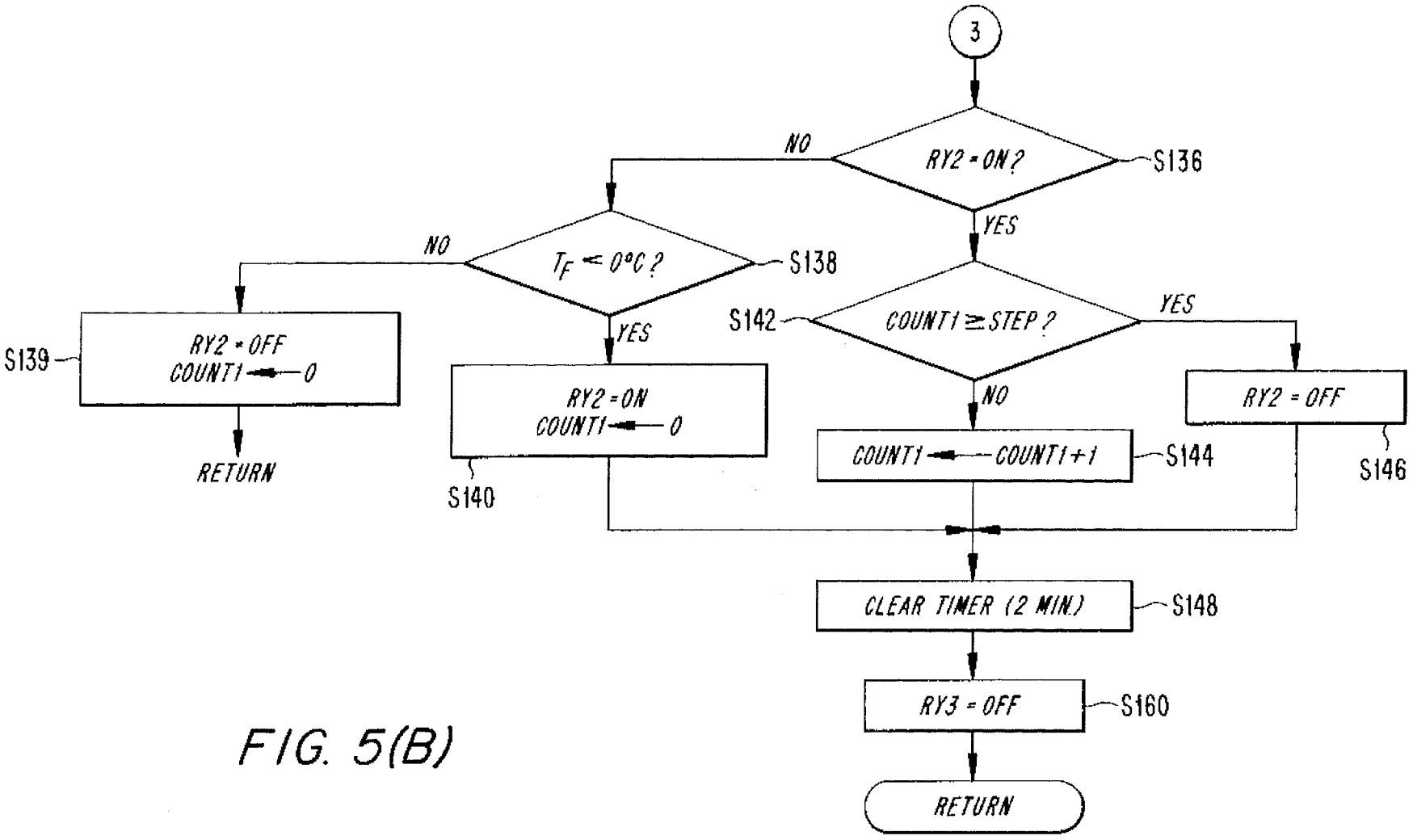
Figure 5C:
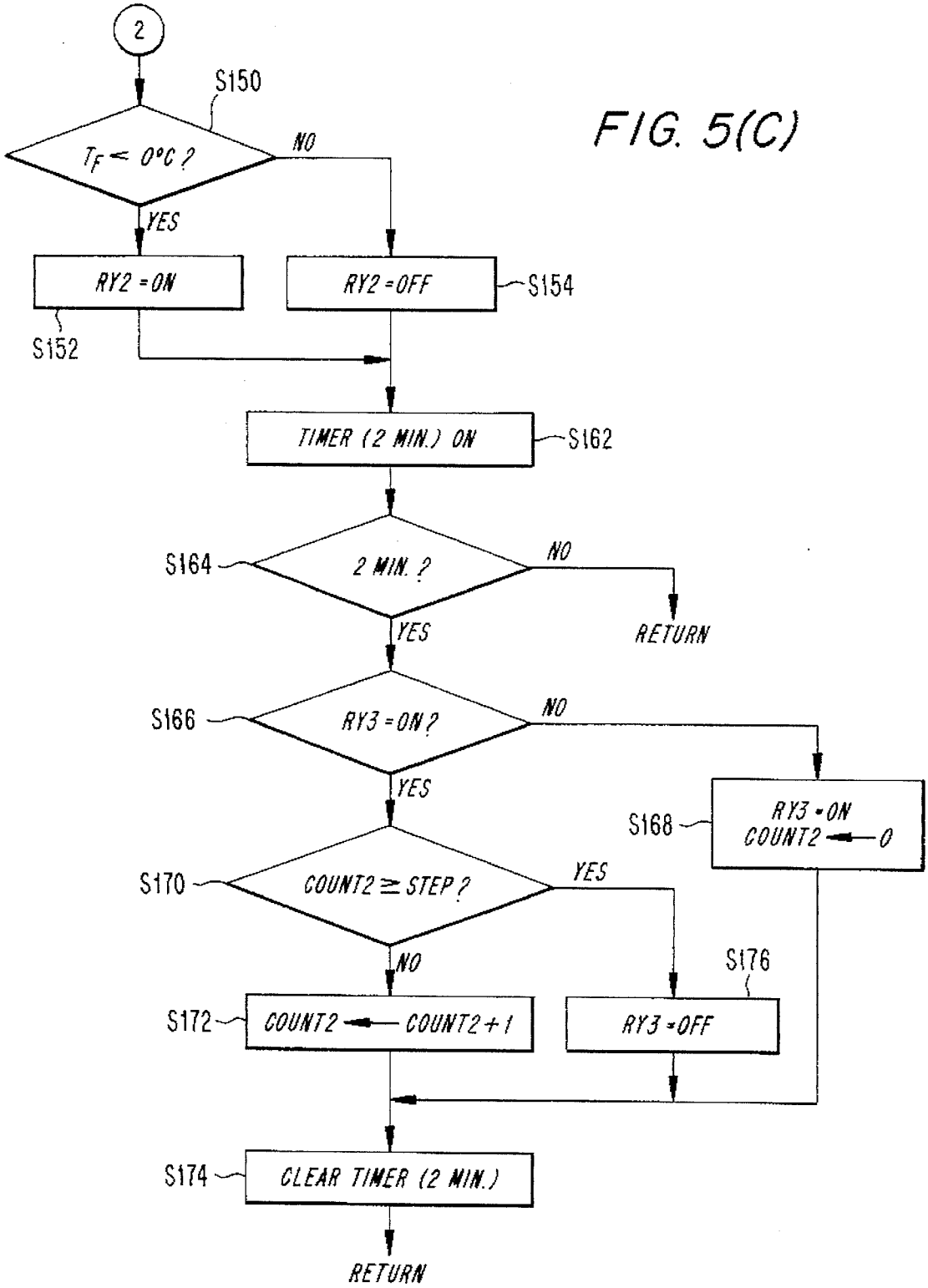
Figures 6A, 6B:
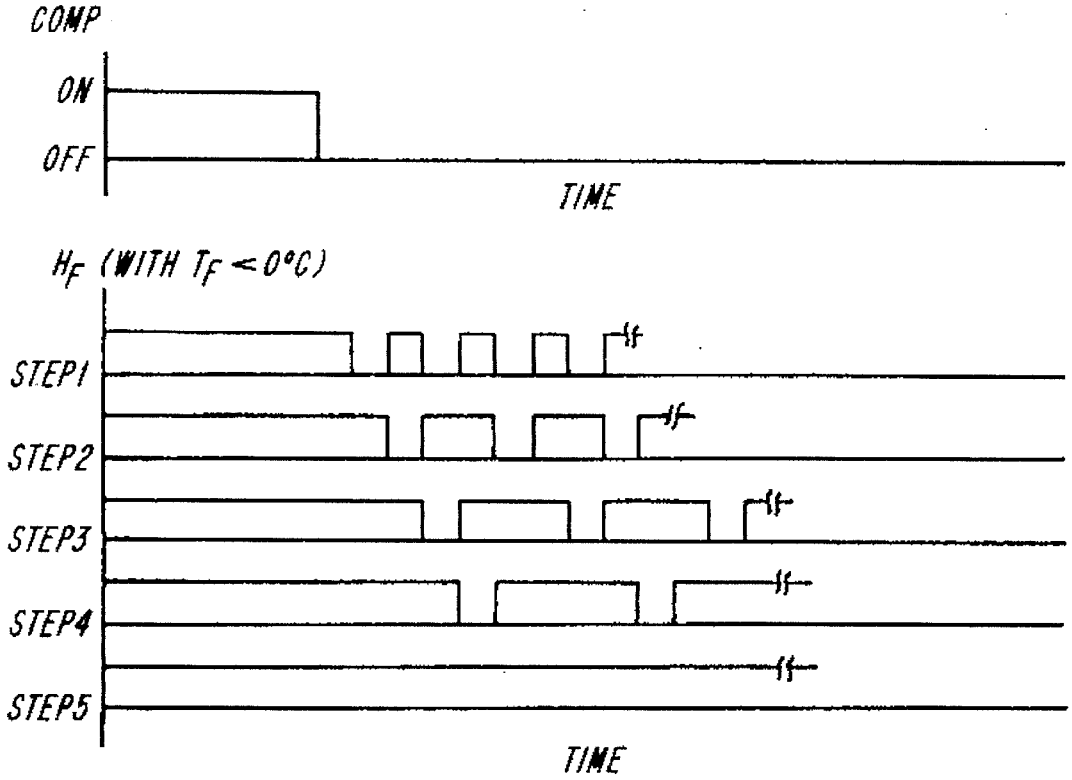
FIGS. 6(A) and (B) are timing charts of the activation pattern of a dew formation prevention heater for a freezing compartment in relation to the magnitude of the outdoor temperature; and, FIGS. 7(A) and (B) are timing charts of the activation pattern of a dew formation prevention heater for a refrigerating compartment in relation to the magnitude of the outdoor temperature.

FIGS. 5(A) to (C) are flow charts explaining a method for controlling the activation of dew formation prevention heaters according to the present invention, FIGS. 6(A) and (B) are timing charts of the activation pattern of a dew formation prevention heater for a freezing compartment in relation to the magnitude of the outdoor temperature, and FIGS. 7(A) and (B) are timing charts of the activation pattern of a dew formation prevention heater for a refrigerating compartment in relation to the magnitude of the outdoor temperature.

As will be explained in detail hereinafter regarding the dew prevention heater ($H_F$) of the freezer compartment, that heater $H_F$ cannot be activated if the freezer temperature ($T_F$) is at or above 0° C. If $T_F$ is below 0° C., then the activation of $H_F$ depends upon whether the compression is on. That is, if the compressor is on, then $H_F$ will also be on; if the compressor is off, then $H_F$ will cycle on and off intermittently at a frequency dependent upon the magnitude of the temperature $T_o$ outside of the refrigerator.

As relates to the refrigerating compartment, the activation of the dew prevention heater $H_R$ for that compartment is independent of the temperature $T_R$ of that compartment. Rather, if the compressor is "off", then $H_R$ is "off". If the compressor is "on", then $H_R$ will cycle on and off intermittently at a frequency dependent upon the magnitude of the outer temperature $T_o$.

Intermittent operation of $H_F$ can occur only if the compressor is "off", whereas intermittent operation of $H_R$ occurs only when the compressor is "on".

Also, $H_R$ and $H_F$ can only be "on" simultaneously if $T_F$ is below 0° C., and the compressor is "on" ($H_F$ will be "on" continuously, and $H_R$ will be "on" intermittently).

Referring to FIGS. 5(A) and (B), microprocessor 10 determines the magnitude of the outer temperature To of the refrigerator, which is detected by temperature detecting section 20 and then A/D converted, through steps S100 to S116. That is, if the outer temperature To is 25° C. or higher, numeral 5 is allotted in a data buffer STEP in steps S100 and S102; if the outer temperature To is lower than 25° C. and is 20° C. or higher, numeral 4 is allotted in data buffer STEP in steps S104 and S106; if the outer temperature To is lower than 20° C. and is 15° C. or higher, numeral 3 is allotted in data buffer STEP in steps S108 and S110; if the outer temperature To is lower than 15° C. and is 10° C. or higher, numeral 2 is allotted in data buffer STEP in steps S112 and S114; and, if the temperature To is lower than 10° C., numeral 1 is allotted in data buffer STEP in step S116.

If the grading of the outer temperature To is finished through steps S100 to S116, the program proceeds to step S120, in which it is determined whether or not relay switch RY1 is shut, that is, whether compressor COMP is in operation. If compressor COMP is not in operation in step S120, the program proceeds to step S130, in which microprocessor 10 discerns the grade of the outer temperature To. If numeral 5 is not allotted in data buffer STEP in step S130, that is, outer temperature To is lower than 25° C., the activation and activation timing pattern of F/heater $H_F$ is controlled through steps S120 to S154. To explain this process step by step, a timer for a predetermined time interval, for example, a two minute timer begins to operate in step S132. In step S134, microprocessor 10 determines whether or not two minutes passes by. If two minutes passes by in step S134, the program proceeds to step S136, in which microprocessor 10 determines whether or not relay switch RY2 is shut, that is, whether or not F/heater $H_F$ is activated. If F/heater $H_F$ is not activated in step S136, the program proceeds to steps S138 and S140.

At this time, considering the prevention of food degeneration as more important than that of dew formation, F/heater $H_F$ is activated in step S140 only if the indoor temperature $T_F$ of the freezing compartment is lower than a predetermined value, for example 0° C., whereas F/heater $H_F$ remains in deactivation if the indoor temperature $T_F$ is 0° C. or higher. A counter buffer COUNT1, which increases the count value by one whenever two minutes passes by, is also clear in steps S139 and S140.

If relay switch RY2 is determined to be shut in step S136, that is, F/heater $H_F$ is activated, the program proceeds to step S142, in which microprocessor 10 compares the value of counter buffer COUNT1 with that of data buffer STEP.

If the value of count buffer COUNT1 is not less than that of data buffer STEP in step S142, the program proceeds to step S146, in which the activation of F/heater $H_F$ is stopped. On the other hand, if the value of count buffer COUNT1 is less than that of data buffer STEP in step S142, the program proceeds to step S144, in which the value of count buffer COUNT1 is increased by one. Next, the program proceeds to step S148, in which microprocessor 10 clears the two minute timer.

If numeral 5 is allotted in data buffer STEP in step S130, that is, outer temperature To is 25° C. or higher, the program proceeds to step S150, in which microprocessor 10 determines whether or not the indoor temperature $T_F$ is lower than 0° C. If indoor temperature $T_F$ is lower than 0° C., the program proceeds to step S152, in which F/heater $H_F$ is then activated, whereas if indoor temperature $T_F$ is 0° C. or higher, the program proceeds to step S154, in which F/heater $H_F$ is then deactivated.

The activation of F/heater $H_F$ may be controlled according to the timing pattern shown in FIGS. 6(A) and (B) by the control program described above. That is, while compressor COMP is in operation, F/heater $H_F$ is always activated if the indoor freezer temperature ($T_F$) is below 0° C. On the other hand, the moment the operation of compressor COMP is stopped, intermittent activation of F/heater $H_F$ is started as follows (assuming $T_F$, 0° C.): if outer temperature To is graded as STEP1, F/heater $H_F$ is repeatedly controlled by the timing pattern of a two minute activation and a two minute deactivation; if outer temperature To is graded as STEP2, F/heater $H_F$ is repeatedly controlled by the timing pattern of a four minute activation and a two minute deactivation; if outer temperature To is graded as STEP3, F/heater $H_F$ is repeatedly controlled by the timing pattern of a six minute activation and a two minute deactivation; if outer temperature To is graded as STEP4, F/heater $H_F$ is repeatedly controlled by the timing pattern of an eight minute activation and a two minute deactivation; and, if outer temperature To is graded as STEP5, F/heater $H_F$ is always activated the same as compressor COMP is in operation.

Not shown in FIG. 6(B), if the indoor temperature $T_F$ is 0° C. or higher, F/heater $H_F$ is unconditionally deactivated regardless of the timing pattern shown in FIG. 6(B).

Hereinafter, the control process of R/heater $H_R$ will be explained in detail. The activation of R/heater $H_R$ is controlled through steps S120 and S160 to S176.

If compressor COMP is not in operation in step S120, the program proceeds to step S160, in which R/heater $H_R$ is unconditionally deactivated. On the other hand, if compressor COMP is in operation in step S120, the activation of R/heater $H_R$ is intermittently controlled based on the grade of outer temperature To, as shown in FIGS. 7(A) and (B). The activation timing pattern of R/heater $H_R$ is almost reverse to that of F/heater $H_F$ as follows: if outer temperature To is graded STEP5, R/heater $H_R$ is always activated after two minutes passes by from the moment of the operation of compressor COMP; if outer temperature To is graded STEP4, R/heater $H_R$ is repeatedly controlled by the timing pattern of a two minute deactivation and an eight minute activation; if outer temperature To is graded STEP3, R/heater $H_R$ is repeatedly controlled by the timing pattern of a two minute deactivation and a six minute activation; if outer temperature To is graded STEP2, R/heater $H_R$ is repeatedly controlled by the timing pattern of a two minute deactivation and a four minute activation; and, if outer temperature To is graded STEP1, R/heater $H_R$ is repeatedly controlled by the timing pattern of a two minute deactivation and a two minute activation.

In the afore-mentioned activation timing pattern of F/heater $H_F$ and R/heater $H_R$, the activation and deactivation time intervals may be properly increased or decreased.

The control method for a dew formation prevention heater as described above is invented on the basis of the fact that the formation of dew increases in proportion to the difference in the indoor and outer temperatures. Accordingly, as to the freezing compartment in which the difference in indoor and outer temperatures is relatively greater, the intermittent activation of F/heater $H_F$ is performed only while compressor COMP is not in operation. On the other hand, as to the refrigerating compartment in which the difference in indoor and outer temperatures is relatively less, the intermittent activation of R/heater $H_R$ is performed only while compressor COMP is in operation.

I claim:

1. A method for controlling a dew prevention heater of a refrigerator which includes a housing forming at least one food storage compartment, a mechanism for carrying out a refrigeration cycle, two doors mounted on said housing for closing said at least one compartment, each door being hinged at one of its edges and including a free edge arranged opposite a free edge of the other door when both doors are closed, a partition member mounted to said housing and arranged to extend across a gap formed between said free edges when the doors are closed, to resist heat loss, said dew prevention heater disposed on said partition member for preventing the formation of dew thereon, said method comprising the steps of:

A) measuring an outer temperature at an exterior of said housing, and

B) intermittently operating the dew prevention heater at a frequency dependent upon the magnitude of the measured outer temperature.

2. The method according to claim 1 further including the steps of determining whether the refrigeration cycle is being carried out, and performing step B only if the refrigeration cycle is not being carried out.

3. The method according to claim 2, wherein said at least one food storage compartment is a freezer compartment.

4. The method according to claim 1, further including the steps of determining whether the refrigeration cycle is being carried out, and performing step B only if the refrigeration cycle is being carried out.

5. The method according to claim 4, wherein said at least one food storage compartment is a refrigerating compartment.

6. The method according to claim 1, further including the steps of measuring an inside temperature of said at least one compartment, and terminating operation of said dew prevention heater when the measured temperature exceeds a predetermined value.

7. The method according to claim 6, wherein the predetermined temperature is substantially 0° C.

8. The method according to claim 1, further including the steps of determining whether the refrigeration cycle is being carried out, and terminating operation of said heater when the refrigeration cycle is determined as not being carried out.

9. The method according to claim 1, wherein step B comprises operating said heater for progressively longer periods as the outer temperature becomes higher.

10. A method for controlling a dew prevention heater of a refrigerator which includes a food storage compartment, comprising the steps of:

A) measuring an outer temperature at an exterior of the refrigerator, and

B) intermittently operating the dew prevention heater at a frequency dependent upon the magnitude of the measured outer temperature.

11. The method according to claim 10, wherein step B comprises operating said heater for progressively longer periods as the outer temperature becomes higher.

12. The method according to claim 10, wherein step B is performed only when the refrigeration cycle is not being carried out.

13. The method according to claim 10, wherein step B is performed only when the refrigeration cycle is being carried out.

14. The method according to claim 10 including the step of terminating operation of said heater when an inside temperature of said at least one food storage compartment exceeds a predetermined value.

* * * * *